US008600249B2

(12) United States Patent
Kawaguchi et al.

(10) Patent No.: US 8,600,249 B2
(45) Date of Patent: Dec. 3, 2013

(54) IMAGE FORMING APPARATUS

(75) Inventors: Yuji Kawaguchi, Mishima (JP); Motoki Adachi, Ashigarakami-gun (JP); Shuhei Kawasaki, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 430 days.

(21) Appl. No.: 12/538,247

(22) Filed: Aug. 10, 2009

(65) Prior Publication Data

US 2010/0054803 A1 Mar. 4, 2010

(30) Foreign Application Priority Data

Aug. 28, 2008 (JP) ..... 2008-220476

(51) Int. Cl.
*G03G 15/08* (2006.01)

(52) U.S. Cl.
USPC ..... 399/53; 399/227

(58) Field of Classification Search
USPC ..... 399/38, 53, 75, 107, 110, 119, 222, 399/223, 226, 227
See application file for complete search history.

(56) References Cited

U.S. PATENT DOCUMENTS 4,615,612 A * 10/1986 Ohno et al. ..... 399/227
5,724,634 A * 3/1998 Maruta ..... 399/227
6,640,063 B2 10/2003 Adachi et al.
7,068,966 B2 6/2006 Shinohara et al.
7,158,740 B2 1/2007 Shinohara et al.
2004/0057751 A1* 3/2004 Matsuo et al. ..... 399/227

FOREIGN PATENT DOCUMENTS

JP 11-15265 A 1/1999
JP 2005-148319 A 6/2005

* cited by examiner

*Primary Examiner* — Walter L Lindsay, Jr.
*Assistant Examiner* — Benjamin Schmitt
(74) *Attorney, Agent, or Firm* — Fitzpatrick, Cella, Harper & Scinto

(57) ABSTRACT

An image forming apparatus includes a rotatable image bearing member; a plurality of rotatable developer carrying members; a plurality of developing devices in each of which a respective one of the developer carrying members is provided; and a developing device supporting member rotatable in a direction of codirectional peripheral movement with the image bearing member where the supporting member and the image bearing member are opposed to each other and integrally supporting the plurality of said developing devices. The peripheral speed of the developing device supporting member divided by a peripheral speed of the image bearing member at the time when each of the developer carrying members departs from the surface of the image bearing member and is still rubbing the surface of the image bearing member with the developer is larger than 0 and smaller than 1.

6 Claims, 6 Drawing Sheets

IMAGE FORMING APPARATUS

FIELD OF THE INVENTION AND RELATED ART

The present invention relates to a full-color image forming apparatus employing a developing process of the rotary type.

There have been known full-color image forming apparatuses which have a single image bearing member and multiple developing apparatuses. In the case of these image forming apparatuses, the multiple developing apparatuses are supported together by a rotatable supporting member. In an image forming operation carried out by this type of image forming apparatus, multiple electrostatic latent images, which correspond, one for one, to primary color components of an image to be formed, are sequentially formed on the single image bearing member, and each electrostatic latent image is developed by a corresponding developing apparatus placed in the development position by rotating the developing supporting rotary member with a preset timing.

An image forming apparatus, such as the one described above, which employs a developing apparatus supporting rotatable member (rotary), which supports multiple developing apparatuses together and sequentially develops multiple electrostatic latent images to form a single full-color image, has been referred to as an image forming apparatus of the rotary type.

Examples of the structure of a conventional image forming apparatus of the rotary type are disclosed in Japanese Laid-open Patent Application 2005-148319, and Japanese Laid-open Patent Application H11-15265.

Generally speaking, in the case of the development process carried out by an image forming apparatus of the rotary type, it is necessary to sequentially place each of the developing apparatuses provided, one for one, for multiple developers, different in color, in contact with the peripheral surface of an image bearing member, and to separate therefrom. As for the switching of the developing apparatus, the developing supporting member is rotated while the developing apparatus is not in contact with the peripheral surface of the image bearing member.

A conventional image forming apparatus of the rotary type is structured so that each developing apparatus is placed in contact with, or separated from, an image bearing apparatus, by moving a developing apparatus supporting member in the radius direction of the image bearing member, with the use of a cam, or the like, having its own driving force.

However, a conventional image forming apparatus of the rotary type, such as those described above, suffers from the following problems.

As described above, a conventional image forming apparatus of the rotary type is structured so that each developing apparatus is placed in contact with, or separated from, the image bearing member by moving the developing apparatus supporting member in the radius direction of the image bearing member. Therefore, the main assembly of the image forming apparatus had to be provided with the space for moving the developing apparatus supporting member. It had to be also provided with a driving means, such as a cam, for driving the developing supporting member to place each developing apparatus in contact with, or separate from, the image bearing member.

Thus, it has been difficult to reduce a conventional image forming apparatus of the rotary type in size and cost, because the conventional image forming apparatus of the rotary type requires the space, and also, driving means, for moving the entirety of the developing apparatus supporting member to place each developing apparatus in contact with, or separated from, the image bearing member.

SUMMARY OF THE INVENTION

The present invention was made in consideration of the above described problems, and its primary object is to provide an image forming apparatus of the rotary type, which is smaller in size and lower in cost than a conventional image forming apparatus of the rotary type, and yet, is excellent in image quality.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, referring to the appended drawings, the most preferable embodiments of the present invention will be described in detail. However, the measurements, materials, and shapes of the structural components of the image forming apparatuses in the following embodiments of the present invention, and the positional relationship among them, are not intended to limit the present invention in scope, unless specifically noted.

Embodiment 1

First, referring to FIGS. 1-6, the image forming apparatus in the first preferred embodiment of the present invention will be described.

(General Structure of Image Forming Apparatus)

Figure 1:
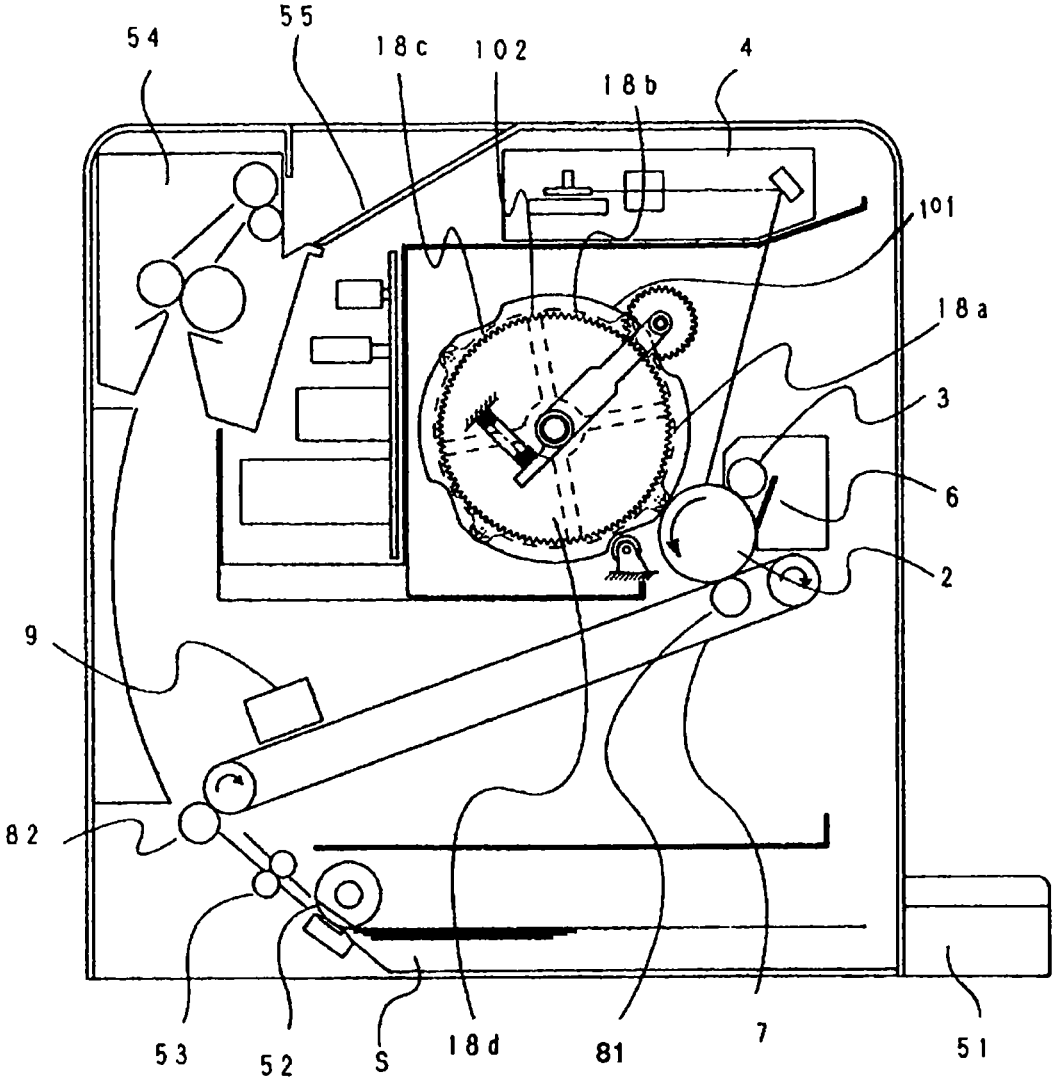
FIG. 1 is a vertical sectional view of the image forming apparatus in the first preferred embodiment of the present invention, and shows the general structure of the image forming apparatus.

Shown in FIG. 1 is the general structure of the image forming apparatus in this embodiment. The image forming apparatus in this embodiment is a color laser printer of the rotary type.

The color laser printer is provided with a rotatable photosensitive drum 2 (image bearing member). Further, the color laser printer is provided with a charge roller 3, an exposing device 4, and a cleaning apparatus 6, which are disposed in the adjacencies of the peripheral surface of the photosensitive drum 2 in a manner to surround the peripheral surface of the photosensitive drum 2. The charge roller 3 is for uniformly charging the peripheral surface of the photosensitive drum 2. The exposing device is for forming an electrostatic latent image on the peripheral surface of the photosensitive drum 2 by projecting a beam of laser light in a manner to scan the peripheral surface of the photosensitive drum 2. The cleaning apparatus 6 is for cleaning the peripheral surface of the photosensitive drum 2.

Further, the color laser printer is provided with developing apparatuses 18*a*-18*d*, which are means for developing an electrostatic latent image on the photosensitive drum 2 by supplying the latent image with developer. The developing apparatuses 18*a*-18*d* are different in the developer color (yellow, magenta, cyan, and black, respectively).

The developing apparatuses 18*a*-18*d* are supported together by a roughly cylindrical rotary 102 (developing apparatus supporting member), which is rotatable in such a direction that the direction in which its peripheral surface moves in the area of development is the same as the direction in which the peripheral surface of the photosensitive drum 2 moves in the area of development. Incidentally, the color laser printer may be structured so that the developing apparatuses 18*a*-18*d* are removably mountable in the rotary 102. Structuring the printer in such a manner makes it possible to individually supply the developing apparatuses 18*a*-18*d* with developer, and also, to individually maintain them.

The image forming operation of the color laser printer is as follows: First, the photosensitive drum 2 is rotated in the direction (counterclockwise direction) indicated by an arrow mark in FIG. 1, in synchronism with the rotation of the intermediary transfer belt 7.

Then, the peripheral surface of the photosensitive drum 2 is uniformly charged by the charge roller 3, across the area which came into contact with the charge roller 3. Then, while the peripheral surface of the photosensitive drum 2 is charged as described, the charged area of the peripheral surface of the photosensitive drum 2 is scanned (exposed) by the beam of light, which corresponds to the yellow component, for example, of the image to be formed, projected by the exposing apparatus. As a result, an electrostatic latent image, which corresponds in color to the yellow color component of an intended image, is formed on the peripheral surface of the photosensitive drum 2.

Meanwhile, the driving force transmitting mechanism, which will be described later, is driven to rotate the rotary 102 to move the yellow developing apparatus 18*a* into the development position before the formation of the electrostatic latent image. The development position is the position in which the developing apparatus 18*a* opposes the photosensitive drum 2.

When the developing apparatus 18*a* is in the development position, the electrostatic latent image on the photosensitive drum 2 can be developed into a visible image formed of yellow developer, by applying a voltage, which is the same in polarity as the developer, to the rotatable development roller 182*a* (developer bearing member) of the developing apparatus 18*a*. That is, the voltage causes the yellow developer to adhere to the electrostatic latent image on the photosensitive drum 2. Hereafter, an image formed of developer will be referred to as a developer image.

After the development of the electrostatic latent image, the developing apparatus 18*a* is separated from the peripheral surface of the photosensitive drum 2. Then, a voltage, which is opposite in polarity to the developer is applied to the primary transfer roller 81, which is disposed on the inward side of the loop which the intermediary transfer belt 7 forms. As the voltage is applied, the developer image on the peripheral surface of the photosensitive drum 2 is transferred (primary transfer) onto the intermediary transfer belt 7.

As soon as the above described primary transfer of the yellow developer image is completed, the rotary 102 is moved back into its separation position, and then, is rotated to move the magenta developing apparatus 18*b* into the development position where the yellow developing apparatus 18*a* was.

Then, the same image forming process as that used to form the yellow developer image is repeated to sequentially form and transfer (primary transfer) magenta, cyan, and black images onto the intermediary transfer belt 7, after the sequential positioning of the developing apparatuses 18*b*-18*d* in the development position. As a result, four developer images, different in color, are transferred in layers onto the intermediary transfer belt 7.

While the four developer images, different in color, are transferred (primary transfer) onto the intermediary transfer belt 7, the secondary transfer roller 82 is kept separated from the intermediary transfer belt 7, and so is the cleaning unit 9 for cleaning the intermediary transfer belt 7.

As for the sheets S of recording medium (which hereafter will be simply referred to as sheets S), they are stored in layers in the sheet feeder cassette 51, which is located in the bottom portion of the main assembly of the color laser printer. Each sheet S is fed into the main assembly by the sheet feeder roller 52 while being separated from the rest, and then, is conveyed to the pair of registration rollers 53.

As the fed sheet S is delivered to the registration rollers 53, the registration rollers 53 send the delivered sheet S to the nip, between the intermediary transfer belt 7 and secondary transfer roller 82, where the secondary transfer roller 82 and intermediary transfer belt 7 are kept pressed upon each other (FIG. 1).

The process for transferring (secondary transfer) a developer image onto the sheet S is as follows: First, the sheet S is conveyed to the nip, and then, a voltage, which is opposite in polarity to the developer charge, is applied to the secondary transfer roller 82 to transfer together (secondary transfer) all the developer images on the intermediary transfer belt 7, onto the sheet S.

After the transfer of the developer images onto the sheet S, the sheet S is sent to a fixing device 54. In the fixing device 54, the sheet S is subjected to heat and pressure, whereby the developer images are permanently fixed to the sheet S. Thereafter, the sheet S is discharged from the fixing device 54 into a delivery portion, which is an integral part of the top cover 55 of the main assembly of the image forming apparatus.

(Structure of Developing Apparatus)

Figure 2:
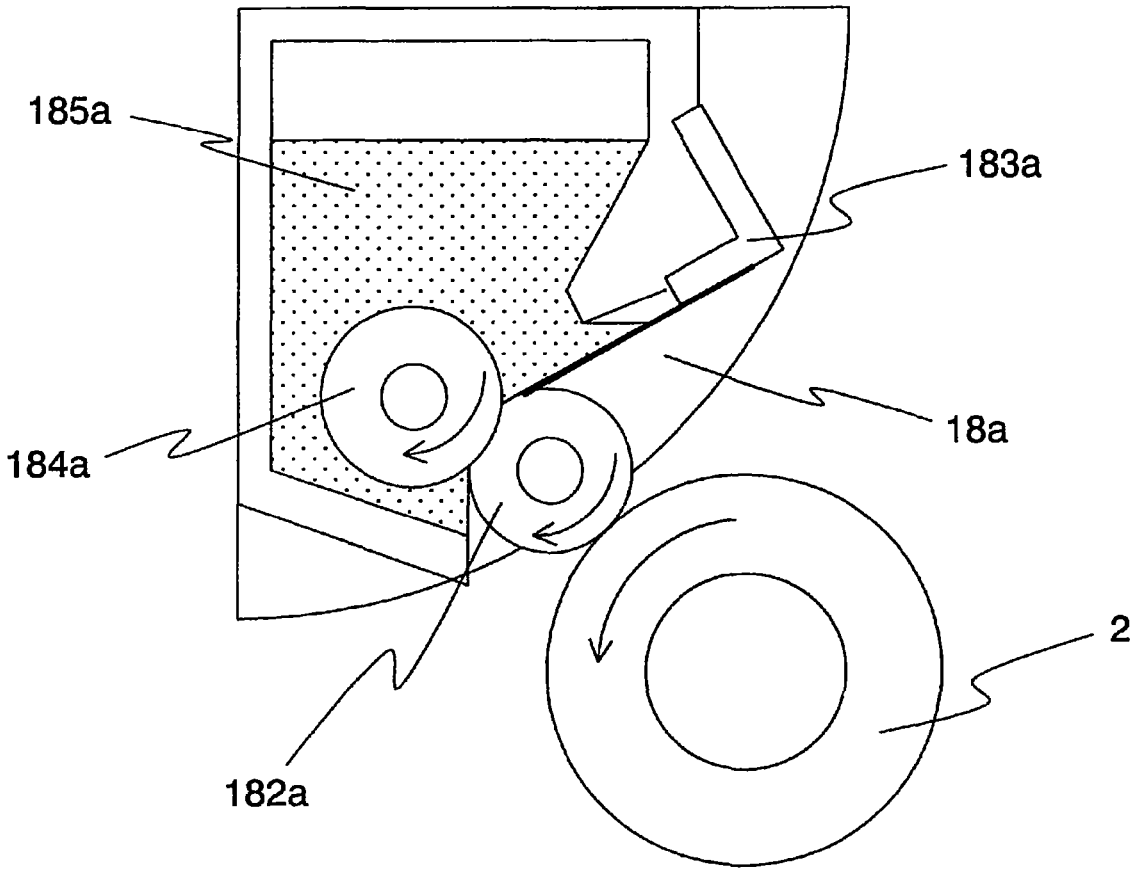
FIG. 2 is a vertical sectional view of the developing apparatus in the first preferred embodiment of the present invention, and shows the general structure of the developing apparatus.

Next, referring to FIG. 2, the structure of developing apparatuses 18*a*-18*d* in this embodiment will be described regarding their structure. FIG. 2 shows the general structure of the developing apparatus 18*a* in this embodiment. Here, only the developing apparatus 18*a*, which corresponds to yellow, will be described. Since the developing apparatuses 18*b*~18*d* is are the same in structure as the developing apparatus 18*a*, their structure will not be described.

The developing apparatuses employed in this embodiment employ a developing method of the contact type. The developing apparatus 18*a*, which is of the contact type, is provided with a development roller 182*a* (as developer bearing member), a regulatory blade 183*a*, a developer supply roller 184*a*, and a developer storage chamber 185*a*.

The development roller 182*a* is structured so that it is rotatable. It supplies the electrostatic latent image, which has just been formed on the photosensitive drum 2 before the development roller 182*a* is placed in contact with the photosensitive drum 2, by being placed in contact with the peripheral surface of the photosensitive drum 2 while bearing developer on its peripheral surface and being rotated.

In this embodiment, the direction in which the peripheral surface of the development roller 182*a* is moved in the interface between the development roller 182*a* and photosensitive drum 2 is the same as the peripheral surface of the photosensitive drum 2 is moved in the interface. The peripheral velocity of the development roller 182*a* is to be set to 160% of that of the photosensitive drum 2.

The development roller 182*a* used in this embodiment is made up of a metallic core, a layer of silicon rubber, and a layer of urethane resin. The metallic core is made of SUS. The silicon layer is adhered, as the base layer, to the peripheral surface of the metallic core. The urethane layer is coated, as the surface layer, on the silicon rubber layer.

As the regulation blade 183*a*, a thin (80 μm in thickness) piece of SUS is used. The regulation blade 18*a* is positioned so that its regulating edge will be on the upstream side of its base portion in terms of the rotational direction of the development roller 182*a*. Positioning the regulation blade 183*a* as described makes it possible to regulate the amount by which the developer is allowed to remain coated on the peripheral surface of the development roller 182*a* as the development roller 182*a* is rotated.

The developer supply roller 184*a* is made up of a metallic core, and a layer of urethane sponge wrapped around the peripheral surface of the metallic core. The developer supply roller 184*a* is temporarily impregnated with the developer, and then, the developer in the developer supply roller 184*a* is supplied to the peripheral surface of the development roller 182*a*, in the interface between the developer supply roller 184*a* and development roller 182*a*.

The development roller 182*a* and developer supply roller 184*a* are rotated in the same direction. That is, in their interface, the peripheral surface of the development roller 182*a* and the peripheral surface of the developer supply roller 184*a* move in the opposite direction relative to each other.

Further, the image forming apparatus is structured so that a voltage is applied to various members of the developing apparatus which is in the development position, into which each developing apparatus is moved by the operation, which will be described later; when the developing apparatus 18*a* is in the development position, the voltage is applied to the various members of the developing apparatus 18*a*.

During the development operation of the image forming apparatus in this embodiment, the potential level of the unexposed portion of the peripheral surface of the photosensitive drum 2 is −500 V, and the potential level of the exposed portion of the peripheral surface of the photosensitive drum 2 is −150 V, whereas the potential level of the voltage applied to the development roller 182*a*, regulation blade 183*a*, and developer supply roller 184*a* is roughly −350 V, for example.

Since the potential levels of the abovementioned members, portions, etc., are set as described above, the negatively charged developer does not adhere to the unexposed portions of the peripheral surface of the photosensitive drum 2, and is adhered to the exposed portions of the peripheral surface of the photosensitive drum 2 by electrostatic force.

(Structure of Developing Apparatus Supporting Member)

Figure 3:
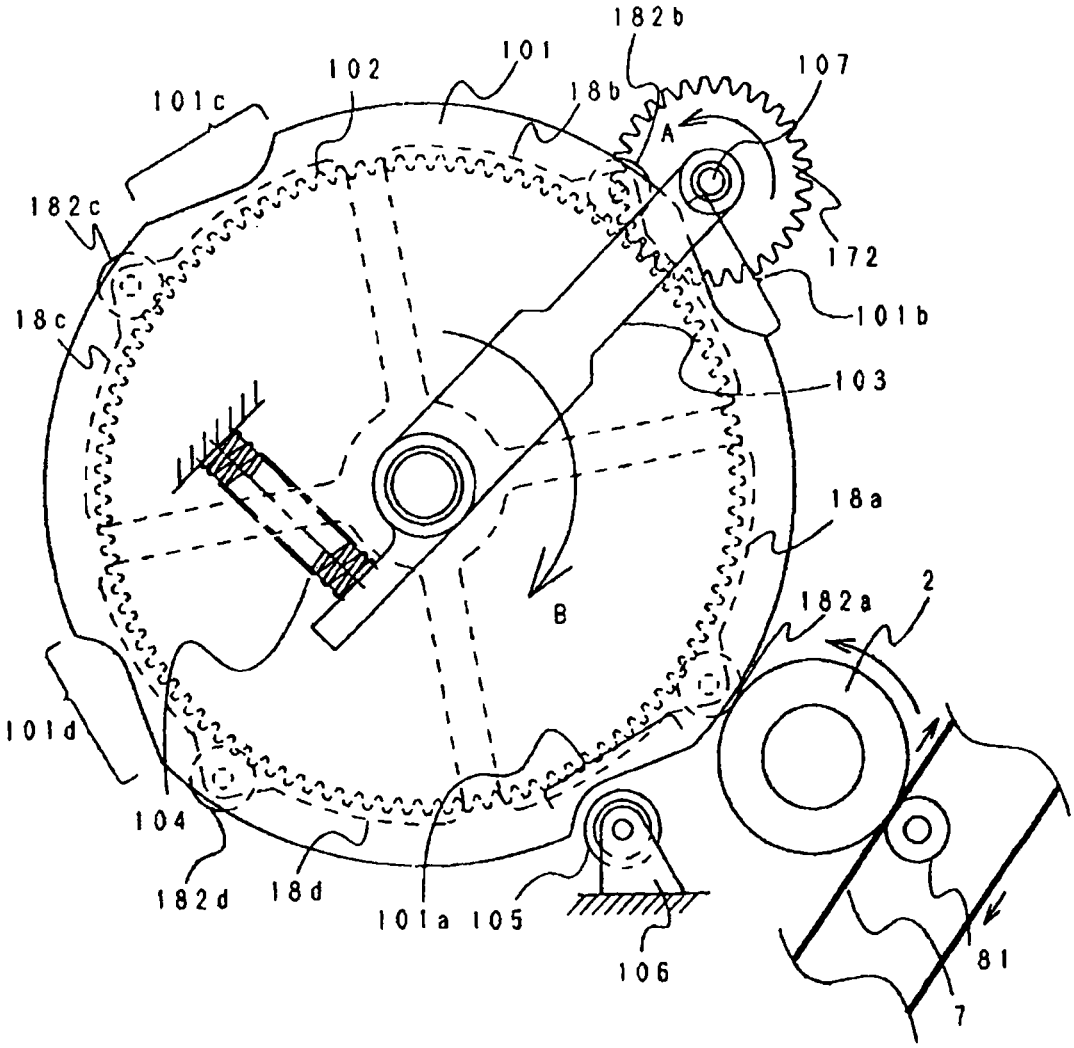
FIG. 3 is a phantom view of the rotary, and the adjacent members to the rotary, in the first preferred embodiment of the present invention.

Next, referring to FIG. 3, the structure of the rotary 102 (developing apparatus supporting member), and the structure of the members adjacent to the rotary 102, in this embodiment, will be described. FIG. 3 shows the state of the rotary, and the state of the developing apparatuses in the rotary, in which the development roller 182*a*, which is rotatably supported by the developing apparatus 18*a*, is developing the electrostatic latent image on the peripheral surface of the photosensitive drum 2.

The rotary 102 is roughly cylindrical, and is rotatably structured. Its peripheral surface is provided with gear teeth, which are in engagement with a driving gear 172. Thus, as driving force is transmitted from an unshown driving force source to the driving gear 172, the rotary 102 rotates. As the driving gear 172 rotates in the direction indicated by an arrow mark A in FIG. 3, the rotary 102 rotates in the direction indicated by an arrow mark B. As the driving gear 172 stops, the rotary 102 also stops.

The driving gear 172 is supported by the main assembly of the image forming apparatus; the driving gear 172 is supported by the shaft 107, which is supported by the main assembly. As the unshown driving force source stops, the driving gear 172 stops. However, the driving force source cannot be driven by the driving gear 172.

The shaft 107 of the driving gear 172 is connected to the rotational axle of the rotary 102 by an arm 103, which is rotatably supported by the shaft 107. Further, one end of the arm 103 is under the pressure from an arm spring 104 attached to the main assembly. Thus, the arm 103 remains under such a pressure that works in the direction to rotate the arm 103 about the shaft 107.

The rotary 102 supports the developing apparatuses 18*a*-18*d* so that the outermost point of each of the development rollers 182*a*-182*d* of the development apparatuses 18*a*-18*d*, respectively, in terms of the radius direction of the rotary 102, roughly coincides with the peripheral surface of the rotary 102. Incidentally, the image forming apparatus may be structured so that the developing apparatuses 18*a*-18*d* are fixed to the rotary 102, or removably mountable in the rotary 102.

Further, the rotary 102 is provided with a rotatable cam 101, which is coaxial with the rotary 102. The cam 101 has four recesses 101*a*-101*d*, which are on the outward side of the cam 101 in terms of the radius direction of the rotary 102. The four recesses 101*a*-101*d* are the same in shape, and are distributed with equal intervals in terms of the circumferential direction of the cam 101. The cam 101 is connected to the rotary 102 so that its rotational axis coincides with that of the rotary 102.

That is, the rotary 102 is structured so that the cam 101 always moves in synchronism with the main assembly of the rotary 102. In this embodiment, the rotary 102 and cam 101 are independent from each other. However, the cam 101 may be formed as a part of the main assembly of the rotary 102.

Further, the main assembly of the image forming apparatus is provided with a regulation roller 105, which is positioned next to the cam 101 so that it remains in contact with the peripheral surface of the cam 101. The regulation roller 105 is rotatably supported, while remaining in contact with the peripheral surface of the cam 101, by a roller holder 106, with which the main assembly is provided.

The surface layer of the regulation roller 105 is formed of elastic rubber. Providing the regulation roller 105 with the surface layer made of elastic rubber can significantly reduce the noises attributable to the contact between the regulation roller 105 and the peripheral surface of the cam 101. Moreover, the coefficient of friction of the rubber layer, which is significantly higher than that of the substrate portion of the regulation roller 105, ensures the cam 101 is rotated by the regulation roller 105.

In this embodiment, the regulation roller 105 is rotatably supported by the roller holder 106. However, in a case where a roller, the peripheral surface of which is excellent in terms of slipperiness, is used as the regulation roller 105, it is unnecessary for the regulation roller 105 to be rotatable. Besides, it is unnecessary for the regulating member (105) to be in the form of a roller. In other words, all that is necessary is that it is ensured that as the cam 101 is rotated, the regulating member (105) remains in contact with the peripheral surface of the cam 101 without interfering with the rotation of the cam 101.

Referring to FIG. 3, the regulation roller 105 is in the adjacencies of the recess 101*a* (-101*d*) of the cam 101, being positioned so that the regulation roller 105 does not contact the cam 101.

The arm 103, which is under the pressure from the arm spring 104, presses on the rotary 102. This pressure applied to the rotary 102 generates the contact pressure between the development roller 182*a* (-182*d*) and photosensitive drum 2.

As described above, in FIG. 3, the image forming apparatus is structured so that the development roller 182*a* is kept pressed upon the peripheral surface of the photosensitive drum 2, by the pressure from the arm spring 104, with the presence of a proper amount of contact pressure between the development roller 182*a* and photosensitive drum 2. However, as the rotary 102 is rotated, the development roller 182*a* is kept separated from the photosensitive drum 2 while the rotary 102 is rotated.

That is, while a latent image is developed, the rotary 102 is kept stationary. Then, as soon as the development of the latent image is completed, the rotary 102 is rotated again, causing therefore the development roller 182*a* to be separated from the peripheral surface of the photosensitive drum 2.

Then, virtually at the same time as the development roller 182*a* separates from the peripheral surface of the photosensitive drum 2, the cam 101 comes into contact with the regulation roller 105.

The peripheral surface of the cam 101 is shaped so that while the regulation roller 105 is in contact with the portions of the peripheral surface of the cam 101 other than the recess portions 101*a*-101*d*, developing apparatuses 18*a*-18*d* do not contact the photosensitive drum 2.

Therefore, the developing apparatuses 18*a*-18*d* can be sequentially moved into the development position, and be placed in contact with the photosensitive drum 2, without affecting the photosensitive drum 2 at all.

More concretely, as the developing apparatus 18*b* (-18*d*) is moved into the development position, an unshown controller cuts off the driving force to the driving gear 172, and the recessed portion 101*b* (-110*d*) of the cam 101 comes into the adjacencies of regulation roller 105. Thus, the development roller 182*b* (-182*d*) is placed in contact with the photosensitive drum 2 so that a preset amount of contact pressure is generated between the development roller 182*b* and photosensitive drum 2. Thus, the electrostatic latent images sequentially formed on the peripheral surface of the photosensitive drum 2 are sequentially developed by the developing apparatuses 18*a*-18*d*.

As described above, in this embodiment, the image forming apparatus is structured so that all that is necessary to sequentially place the development rollers 182*a*-182*d* in contact with the peripheral surface of the photosensitive drum 2, and separate them from the peripheral surface of the photosensitive drum 2, is to rotate the rotary 102.

That is, in this embodiment, the direction in which the development rollers 182*a*-182*d* are moved to be placed in contact, or separated from, the peripheral surface of the photosensitive drum 2, is parallel to the line which is tangential to the peripheral surface of the photosensitive drum 2 and coincides with the expected point of contact between the development rollers 182*a*-182*d* and photosensitive 2. That is, the image forming apparatus in this embodiment is quite different in structure from a conventional image forming apparatus structured so that the development roller is moved in the radius direction of the development roller to be placed in contact with, or separated from, the photosensitive drum.

That is, in this embodiment, the image forming apparatus does not need to be structured to enable the rotary 102, for example, to be moved in the radius direction of the photosensitive drum 2, making it unnecessary to provide the main assembly of the image forming apparatus with the space for placing the development rollers 182*a*-182*d* in contact with, or separated from, the photosensitive drum 2, making it thereby possible to significantly reduce in size the main assembly of the apparatus, compared to a conventional image forming apparatus of the rotary type.

Further, the development roller 182*a*-182*d* are placed in contact with, or separated from, the photosensitive drum 2 simply by rotating the rotary 102 to switch the developing apparatus in the development position with the next developing apparatus. Thus, the structural arrangement, driving force source, etc., dedicated to the placing of a development roller in contact with, or the separation of the development roller from, the photosensitive drum 2, are unnecessary. Thus, the image forming apparatus in this embodiment is significantly smaller in manufacturing cost than a conventional image forming apparatus of the rotary type; the present invention can significantly reduce an image forming apparatus of the rotary type, in manufacturing cost.

Further, in the case of the image forming apparatus of the rotary type in this embodiment, the operation for placing one of the developing apparatuses 18*a*-18*d* in contact with, or separating from, the peripheral surface of the photosensitive drum 2, and the operation for replacing the developing apparatus 18 in the development position with the next developing apparatus 18, are simultaneously carried out, and therefore, the image forming apparatus of the rotary type in this embodiment is significantly higher in the speed with which the development rollers 182*a*-182*d* are sequentially placed in contact with, or separated from, the photosensitive drum 2.

(Mechanism of Formation of Developer Stripe on Peripheral Surface of Image Bearing Member Due to Rubbing)

However, in the case of an image forming apparatus, the development rollers 182*a*-182*d* of which are placed in contact with, or separated from, the peripheral surface of the photosensitive drum 2 in the direction parallel to the tangential line of the photosensitive drum 2, which coincides with the expected point of contact between the development roller 182 and photosensitive drum 2, it is possible that the following problem will occur.

That is, when the rotation of the rotary 102 is restarted (when development roller 182 is separated from photosensitive drum 2) after the development of the electrostatic latent image on the photosensitive drum 2 by the development roller 182 while the rotary 102 is kept stationary, the peripheral surface of the development roller 182 rubs against the peripheral surface of the photosensitive drum 2.

In this embodiment, in order to place the development roller 182 in contact with, or separated from, the peripheral surface of the photosensitive drum 2, the development roller 182 is moved in the direction parallel to the line which is tangential to the peripheral surface of the photosensitive drum 2 and coincides with the expected point of contact between the development roller 182 and photosensitive drum 2 as described above. Thus, the peripheral surface of the development roller 182 and the peripheral surface of the photosensitive drum 2 in this embodiment are likely to rub against each other unlike the counterparts of an image forming apparatus of the conventional rotary type, the development roller 182 of which is moved in the radius direction of the image bearing member to be placed in contact with, or separated from, the image bearing member.

Thus, as the two surfaces rub against each other, the developer on the peripheral surface of the development roller 182*a* is rubbed against the peripheral surface of the photosensitive drum 2. As a result, a stripe of the developer is left on the peripheral surface of the photosensitive drum 2. The extent of the rubbing is affected by the relationship between the peripheral velocity of the rotary 102 and that of the photosensitive drum 2. With the presence of the stripe of developer on the peripheral surface of the photosensitive drum 2, unsatisfactory copies, for example, a copy, the back side of which is soiled, or the like, will be yielded. In other words, it is difficult to obtain a copy of high quality.

Thus, in order to minimize the amount by which the developer is left, in the form of a stripe, on the peripheral surface of the photosensitive drum 2 when the development roller 182 separates from the peripheral surface of the photosensitive drum 2, the image forming apparatus in this embodiment is structured so that the rotary 102 and photosensitive drum 2 can be controlled in peripheral velocity. This is the characteristic feature of the image forming apparatus in this embodiment. Next, this feature will be described.

First, referring to FIGS. 5(*a*)-5(*c*), the mechanism of the formation of developer stripe which occurs when the development roller 182*a* is separated from the photosensitive drum 2, will be described. The mechanism will be described with reference to the development roller 182*a*. Since the development rollers 182*b*-182*d* are the same in structure as the development roller 182*a*, the formation of developer stripe by them will not be described.

Figure 5:
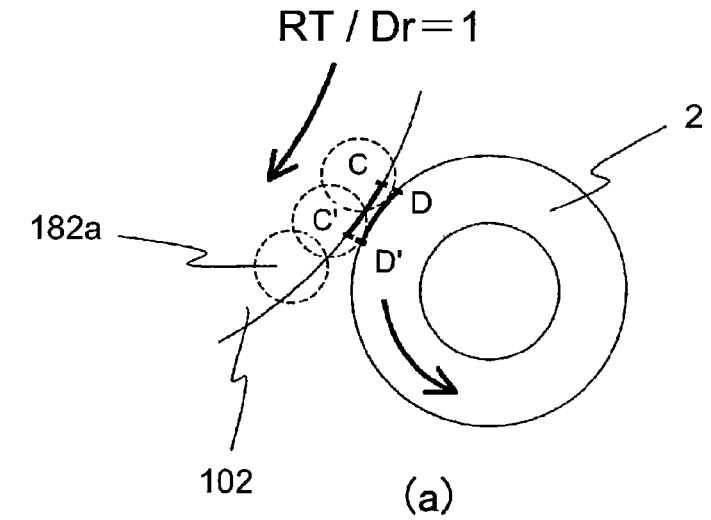
FIGS. 5(*a*), 5(*b*), and 5(*c*) are drawings which show the state of contact between the development roller and photosensitive drum under three conditions which are different in the peripheral velocity ratio between the development roller and photosensitive drum.
Figure 5:
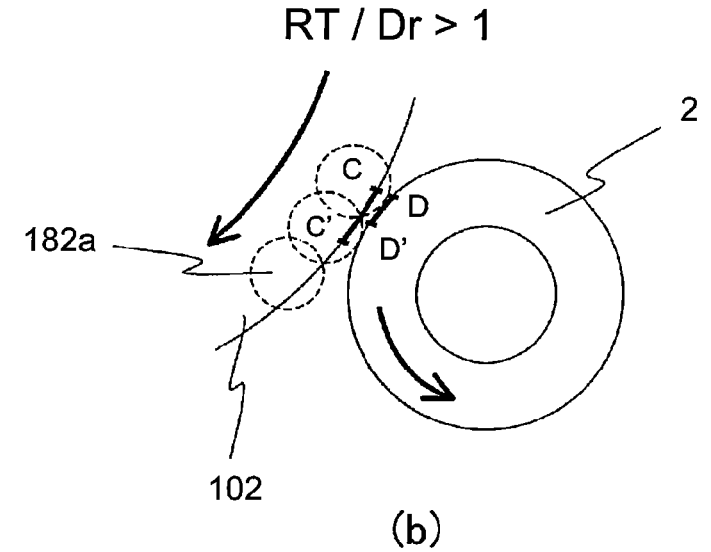
Figure 5:
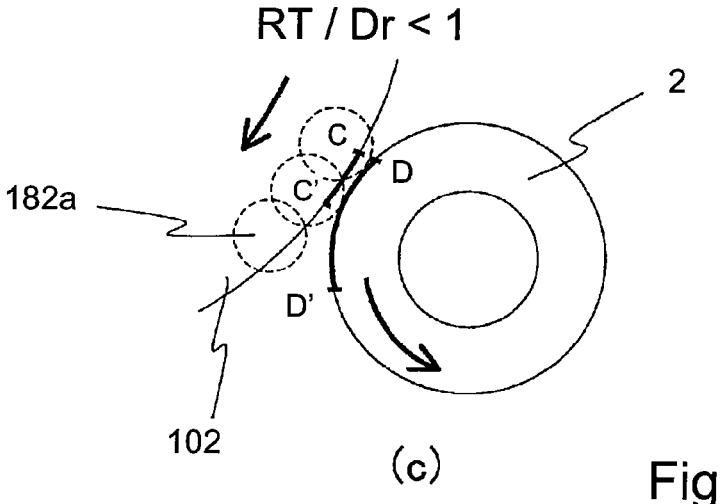

FIGS. 5(*a*)-5(*c*) show the photosensitive drum 2 and development roller 182*a* at the moment of separation of development roller 182*a* from the photosensitive drum 2. In FIGS. 5(*a*)-5(*c*), RT and Dr stand for the peripheral velocity of the rotary 102, and the peripheral velocity of the photosensitive drum 2, respectively. The drawings represent the cases in which the following relationships are satisfied by RT and Dr:

$$RT/Dr=1 \quad 5(a),$$

$$RT/Dr>1 \quad 5(b),$$

$$RT/Dr<1 \quad 5(c).$$

Further, C, C', D, D' in the drawings are for showing the distance which the peripheral surface of the development roller 182*a* moves, and the range of the peripheral surface of the photosensitive drum 2, across which the peripheral surface of the photosensitive drum 2 is rubbed by the development roller 182*a*, when the development roller 182*a* separates from the photosensitive drum 2.

That is, when separating from the photosensitive drum 2, the development roller 182*a* moves from Point C to Point C' while rubbing the peripheral surface of the photosensitive drum 2, whereas the peripheral surface of the photosensitive drum 2 is covered with the developer deposited on the peripheral surface of the photosensitive drum 2 by being rubbed against the peripheral surface of the photosensitive drum 2 by the development roller 182*a*, across the area from Point D to Point D'.

<RT/Dr=1 (FIG. 5(*a*))>

First, referring to FIG. 5(*a*), in the case where the rotary 102 and photosensitive drum 2 are the same in peripheral velocity (RT/Dr=1), the peripheral surface of the photosensitive drum 2 and peripheral surface of the development roller 182*a* rotationally move at the same velocity.

Therefore, the developer on the peripheral surface of the development roller 182*a* is rubbed onto the peripheral surface of the photosensitive drum 2 by the same amount per unit area as the amount of developer on the development roller per unit area. Thus, as the development roller 182*a* separates from the peripheral surface of the photosensitive drum 2, a stripe of developer remains on the peripheral surface of the photosensitive drum 2.

<RT/Dr>1 (FIG. 5(*b*))>

Next, referring to FIG. 5(*b*), in the case where the peripheral velocity RT of the rotary 102 at the moment when the development roller 182*a* separates from the peripheral surface of the photosensitive drum 2, is greater than the peripheral velocity Dr of the photosensitive drum 2 at the moment when the development roller 182*a* separates from the photosensitive drum 2 (RT/Dr>1), the developer stripe attributable to the rubbing of the peripheral surface of the development roller 182*a* and the peripheral surface of the photosensitive drum 2 relative to each other is generated across a smaller area of the peripheral surface of the photosensitive drum 2.

That is, the preset amount of developer on the development roller 182*a*, which is on the development roller 182*a*, is rubbed onto the smaller area of the peripheral surface of the photosensitive drum 2 than when RT/Dr=1. Therefore, a narrower and denser developer stripe is generated on the peripheral surface of the photosensitive drum 2.

<RT/Dr<1 (FIG. 5(*c*))>

Next, referring to FIG. 5(*c*), in the case where the peripheral velocity RT of the rotary 102 at the moment when the development roller 182*a* separates from the peripheral surface of the photosensitive drum 2, is less than the peripheral velocity Dr of the photosensitive drum 2 at the moment when the development roller 182*a* separates from the photosensitive drum 2 (RT/Dr<1), the area of the peripheral surface of the photosensitive drum 2, across which the development roller 182*a* contacts the peripheral surface of the photosensitive drum 2 while moving from the development position to the point of its separation from the photosensitive drum 2, is larger.

Therefore, the preset amount of developer on the development roller is rubbed onto a larger area of the peripheral surface of the photosensitive drum 2. Thus, the resultant developer stripe is less conspicuous.

As described above, the difference in the relationship (ratio) between the distance (distance from Point C to Point C') which the peripheral surface of the development roller 182*a* moves while the development roller 182*a* separates from the photosensitive drum 2, and the distance (distance from Point D to Point D') which the peripheral surface of the photosensitive drum 2 moves while the development roller 182*a* separates from the photosensitive drum 2, affects the appearance of the developer stripe generated on the peripheral surface of the photosensitive drum 2.

That is, it is evident that, in order to ensure that the developer stripe which will be formed on the photosensitive drum 2 will be inconspicuous, it is effective to make the peripheral velocity (RT) of the rotary 102 at the moment when the development roller 182*a* separates from the photosensitive drum 2, less than the peripheral velocity (Dr) of the photosensitive drum 2 at the moment when the development roller 182*a* to separated from the photosensitive drum 2.

(Results of Study of Effects)

Figure 4:
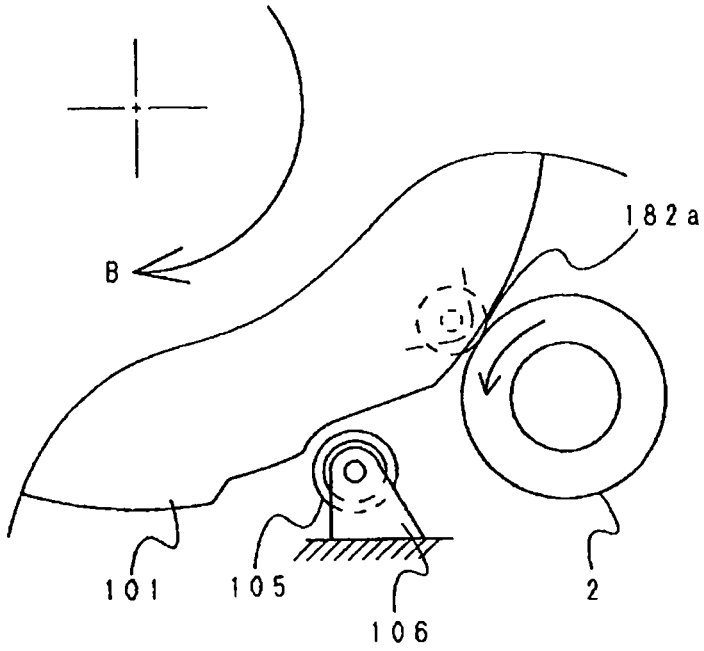
FIG. 4 is a drawing which shows the state of contact between the development roller and photosensitive drum.

The inventors of the present invention studied the relationship between the ratio of the peripheral velocity of the rotary 102 to the peripheral velocity of the photosensitive drum 2, and the appearance of the developer stripe on the peripheral surface of the photosensitive drum 2, when the rotational direction of the photosensitive drum 2 is opposite to the rotational direction of the rotary 102 as shown in FIG. 4.

In the study, the ratio between the peripheral velocity (RT) of the rotary 102 and peripheral velocity (Dr) of the photosensitive drum 2 was to set to several values. Further, the peripheral velocity (mm/sec) of the photosensitive drum 2 was set to two values. Then, whether the developer stripe is generated or not was examined under the various conditions created by combining the abovementioned ratios with the peripheral velocities of the photosensitive drum 2. The results of the study are shown in Table 1, in which NG stands for the condition under which distinct developer stripe was generated; F stands for the condition under which vaguely visible is developer stripe was generated; and G stands for the condition under which no visible developer stripe was generated. That is, G stands for the condition under which a preferable level of image quality was achieved.

In this study, the rotational direction of the rotary 102 was defined as the positive direction. As for the rotational direction of the photosensitive drum 2, the rotational direction of the photosensitive drum 2, which is opposite to the rotational direction of the rotary 102 was defined as the positive/direction. That is, the rotational direction of the photosensitive drum 2 was considered positive when the direction in which the peripheral surface of the photosensitive drum 2 moves in the area in which the distance between the rotary 102 and photosensitive drum 2 is smallest is the same as the direction in which the peripheral surface of the rotary 102 moves in the same area.

TABLE 1

| | | (Rotary Speed (RT))/(Drum Speed (Dr)) | | | | | |
|---|---|---|---|---|---|---|---|
| | | 0.3 | 0.6 | 0.9 | 1.0 | 1.2 | 2.5 |
| Drum | 50 | G | G | G | F | NG | NG |
| Speed | 100 | G | G | G | F | NG | NG |
| (Dr mm/s) | | | | | | | |

Referring to Table 1, in the case where the peripheral velocity of the photosensitive drum 2 was set to 100 mm/sec, and the peripheral velocity of the rotary 102 was set to 2.5 times the peripheral velocity of the photosensitive drum 2 to rotate the rotary 102 faster than the photosensitive drum 2, a conspicuous developer stripe was generated when the development roller 182 was separated from the photosensitive drum 2. Further, a conspicuous developer stripe was generated even when the peripheral velocity of the rotary 102 was 1.2 times the peripheral velocity of the photosensitive drum 2.

On the other hand, it was confirmed that as the ratio of the peripheral velocity of the rotary 102 to the peripheral velocity of the photosensitive drum 2 was set to a value which is no more than 1.0, the generated developer stripe was significantly less conspicuous.

That is, the distinctive feature of this embodiment is that when the development roller 182*a* separates from the peripheral surface of the photosensitive drum 2, the relationship between the peripheral velocity of the rotary 102 and peripheral surface of the photosensitive drum 2 is made to be such that the ratio of the peripheral velocity of the rotary 102 to the peripheral velocity of the photosensitive drum 2 is no more than 1.0. This distinctive feature is the indispensable condition for preventing the formation of an image having an unwanted developer stripe.

As described above, the generation of a conspicuous developer stripe can be prevented by making the peripheral velocity of the rotary 102 slower than the peripheral velocity of the photosensitive drum 2 at least when the development roller 182 separates from the peripheral surface of the photosensitive drum 2. The prevention of the formation of a conspicuous developer stripe can achieve an excellent level of image quality.

Although it was stated above that the peripheral velocity of the rotary 102 is to be made slower than the peripheral velocity of the photosensitive drum 2 at least when the development roller 182*a* separates from the peripheral surface of the photosensitive drum 2, the peripheral velocity of the rotary 102 may be switched back to the previous speed (higher speed) after the separation.

Increasing the peripheral velocity of the rotary 102 after the separation, and keeping the peripheral velocity of the rotary 102 at the increased velocity, reduces the length of time necessary for the development process, making it possible to provide an image forming apparatus of the rotary type, which is significantly higher in the development speed than a conventional image forming apparatus of the rotary type.

The peripheral velocity of the rotary 102, peripheral velocity of the photosensitive drum 2, and the conditions under which the components other than the rotary 102 and photosensitive drum 2, which are related to the development process, are driven, can be controlled by the unshown control portions (CPU, etc.) with which the main assembly of the apparatus is provided.

As will be evident from the description of the first preferred embodiment of the present invention, not only can the present invention improve an image forming apparatus of the rotary type, in image quality, but also, can reduce in size and cost an image forming apparatus of the rotary type.

Embodiment 2

Figure 6:
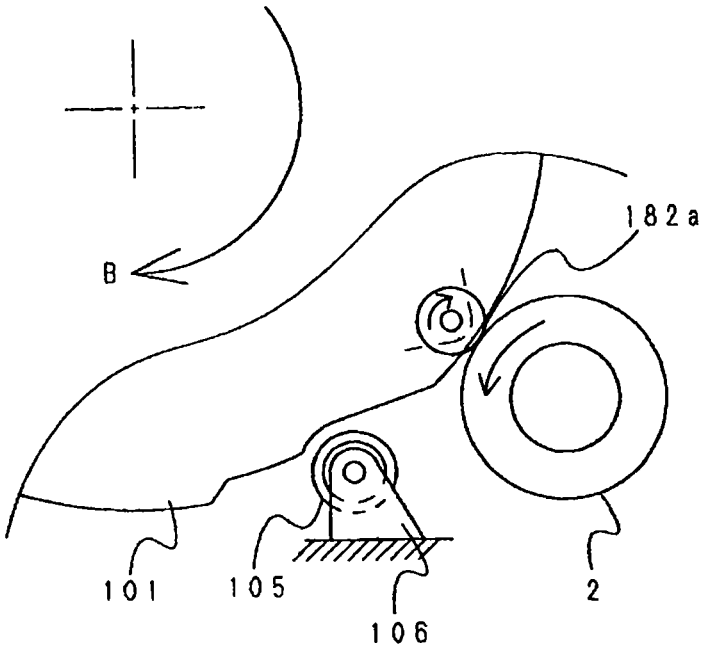
FIG. 6 is a cross-sectional view of the development roller and photosensitive drum in the second preferred embodiment, and shows the state of the contact between the development roller and photosensitive drum.

Next, referring to FIG. 6, the image forming apparatus in the second preferred embodiment of the present invention will be described. FIG. 6 shows the state of contact between the development roller 182*a* and photosensitive drum 2 in this embodiment.

Even in the case where the direction in which the development roller 182 rotates is the same as the direction in which the rotary 102 rotates, as the peripheral velocity of the photosensitive drum 2 is increased relative to the peripheral velocity of the rotary 102 as in the first embodiment, the resultant developer stripe is less conspicuous. However, it is possible that the developer adheres to the peripheral surface of the photosensitive drum 2 due to the effect of the rotation of the development roller 182.

That is, even if the development roller 182 and photosensitive drum 2 satisfy the relationship in peripheral velocity between the rotary 102 and photosensitive drum 2, which was described in the description of the first preferred embodiment, the developer is likely to be rubbed onto a small area of the peripheral surface of the photosensitive drum 2, making it possible that the developer will adhere to the peripheral surface of the photosensitive drum 2, because the development roller 182 is rotating.

It is rare that the above described occurrence of the adhesion of the developer to the peripheral surface of the photosensitive drum 2 results in the formation of an unsatisfactory copy, such as the one soiled across the back side. However, the adhesion results in the unnecessary amount of developer consumption. Further, as the peripheral surface of the development roller 182 and the peripheral surface of the photosensitive drum 2 rub against each other, the photosensitive drum 2 is likely to be changed in peripheral surface properties; for example, the amount of torque necessary to make the peripheral surface of the development roller 182 and the peripheral surface of the photosensitive drum 2 move through the area of contact between the development roller 182 and photosensitive drum 2, is changed, causing the electrostatic latent image to become "blurry", and/or the portion of the intermediary transfer belt 7, which is in the transfer portion, to move, making it possible for the image forming apparatus to yield a defective image.

Thus, in order to reduce the amount of developer consumption by reducing the amount by which the developer adheres to the peripheral surface of the photosensitive drum 2, the inventors of the present invention zealously studied the relationship between the ratio of the peripheral velocity of the development roller 182 to the peripheral velocity of the rotary 102, and the presence (absence) of the developer adhesion. Given in Table 2 is the results of this study. The peripheral velocity of the photosensitive drum 2 was 100 mm/sec, and the development roller 182 was rotated at three different peripheral velocities, whereas the rotary 102 was rotated at four different, peripheral velocities.

Whether the developer adhered to the peripheral surface of the photosensitive drum 2 or not was checked under the following conditions. In the table, NG stands for the developer adhesion and/or presence of developer stripe; F stands for the developer adhesion; and G stands for no developer adhesion. The numbers on the right-hand side of the G, F, and NG are the ratio of the sum of the peripheral velocity of development roller 182 and peripheral velocity of rotary 102, to the peripheral velocity (100 mm/sec) of the photosensitive drum 2. Here, the rotational direction of the development roller 182 is defined as the positive direction when it is the same as the rotational direction of the rotary 102.

TABLE 2

| | | Peripheral Speed of Rotary (mm/sec) | | | |
|---|---|---|---|---|---|
| | | 30 | 60 | 90 | 130 |
| Peripheral Speed of Developing Roller (mm/sec) | 130 | G/1.6 | G/1.9 | G/2.2 | NG/2.6 |
| | 170 | G/2.0 | G/2.3 | G/2.6 | NG/3.0 |
| | 220 | G/2.5 | G/2.8 | G/3.1 | NG/3.5 |

It is evident from the results of this study that the sum of the peripheral velocity of the rotary 102 and the peripheral velocity of the development roller 182*a* is desired to be no more than 2.5 times the peripheral velocity of the photosensitive drum 2.

In this embodiment, as the sum of the peripheral velocity of the rotary 102 and development roller 182*a* was greater than the peripheral velocity of the photosensitive drum 2, the developer on the development roller 182*a* was adhered to the portion of the peripheral surface of the photosensitive drum 2, which happened to be in contact with the development roller 182*a*, by being rubbed onto this portion of the peripheral surface of the photosensitive drum 2.

Thus, the amount by which developer is inadvertently adhered to the peripheral surface of the photosensitive drum 2 can be reduced by reducing the ratio of the sum of the peripheral velocity of the development roller 182*a* and the peripheral velocity of the rotary 102, to the peripheral velocity of the photosensitive drum 2, to a specific value (2.5) or less.

Prevention of the untimely adhesion of the developer onto the peripheral surface of the photosensitive drum 2 can prevent the wasteful developer consumption. In the case of the above described study, the peripheral velocity of the photosensitive drum 2 was set to 100 mm/sec. However, it has been confirmed that the above described relationship holds true regardless of the peripheral velocity of the photosensitive drum 2.

As described above, in this embodiment, the unwanted adhesion of the developer to the photosensitive drum 2 was prevented by adjusting the peripheral velocity of the rotary 102, peripheral velocity of the photosensitive drum 2, and development roller 182*a*. As a result, it was possible to achieve a satisfactory level of image quality.

Incidentally, it is possible that the rubbing of the peripheral surface of the development roller 182 and the peripheral surface of the photosensitive drum 2 against each other will change the peripheral surface of the photosensitive drum 2 in properties, which in turn creates problems; For example, the change in the surface properties of the photosensitive drum 2 may change the torque in the area of contact between the development roller 182 and photosensitive drum 2, causing thereby an electrostatic latent image to be "blurred". Further, the transfer portion, that is, the area of contact between the intermediary transfer belt 7 (sheet S) and the peripheral surface of the photosensitive drum 2, is also affected by the change in the amount of torque, which in turn may resulting in the formation of a streaky image.

However, the image forming apparatus in this embodiment was designed so that the peripheral velocity of the development roller 182 at the moment when the development roller 182 separates from the peripheral surface of the photosensitive drum 2 is less than a preset value. Thus, the image forming apparatus in this embodiment is significantly less likely to suffer from the above described problems.

As will be evident from the description of the first and second preferred embodiments of the present invention, not only does the present invention make it possible to achieve a satisfactory level of image quality with the use of an image forming apparatus of the rotary type, but also, to reduce an image forming apparatus of the rotary type, in size and cost.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 220476/2008 filed Aug. 28, 2008 which is hereby incorporated by reference.

What is claimed is:

1. An image forming apparatus comprising:

a rotatable image bearing member;

a plurality of rotatable developer carrying members contactable to a surface of said image bearing member to supply developers to electrostatic latent images formed on the surface, respectively;

a plurality of developing devices in each of which a respective one of said developer carrying members is provided; and a developing device supporting member rotatable in a direction of codirectional peripheral movement with said image bearing member at a position where said developing device supporting member and said image bearing member are opposed to each other and integrally supporting the plurality of said developing devices, wherein said developer carrying members are capable of contacting to and separating from the surface of said image bearing member sequentially by rotation of said developing device supporting member, wherein each of said developer carrying members develops the electrostatic latent images, moves toward a downstream direction with respect to a rotational direction of said developing device supporting member while said developer carrying member rubs the developer on said image bearing member, and then separates from said image bearing member, and wherein a peripheral speed of said developing device supporting member divided by a peripheral speed of said image bearing member at a time when each of said developer carrying members is about to finish separating from the surface of said image bearing member and is still rubbing the surface of said image bearing member with the developer is not smaller than 0.3 and smaller than 1.

2. The image forming apparatus according to claim 1, wherein a sum of the peripheral speed of said developing device supporting member and a peripheral speed of said developer carrying member, divided by the peripheral speed of said image bearing member at the time when said developer carrying member is about to finish separating from the surface of said image bearing member and is still rubbing the surface of said image bearing member with the developer while said developer carrying member is rotating in the same peripheral moving direction as that of said developing device supporting member, is larger than 0 and smaller than 2.5.

3. The image forming apparatus according to claim 2, wherein the sum of the peripheral speed of said developing device supporting member and the peripheral speed of said developer carrying member, divided by the peripheral speed of said image bearing member is not smaller than 1.6 at the time when said developer carrying member is about to finish separating from the surface of said image bearing member and is still rubbing the surface of said image bearing member with the developer.

4. The image forming apparatus according to claim 3, wherein the peripheral speed of the developer carrying member is not lower than 130 mm/sec and not higher than 220 mm/sec at the time when said developer carrying member is about to finish separating from the surface of said image bearing member and is still rubbing the surface of said image bearing member with the developer.

5. The image forming apparatus according to claim 3, wherein the peripheral speed of said developing device supporting member is not lower than 30 mm/sec and not higher than 90 mm/sec at the time when said developer carrying member is about to finish separating from the surface of said image bearing member and is still rubbing the surface of said image bearing member with the developer.

6. The image forming apparatus according to claim 1, wherein the peripheral speed of said developing device supporting member divided by the peripheral speed of said image bearing member is not larger than 0.9 at the time when said developer carrying member is about to finish separating from the surface of said image bearing member and is still rubbing the surface of said image bearing member with the developer.

* * * * *